340-566 SR
10/26/82 XR 4,356,364

United States Patent [19]

Soto

[11] 4,356,364

[45] Oct. 26, 1982

[54] SHOCK-SENSITIVE ELECTRICAL SWITCH

[76] Inventor: John Soto, 1133 Rex Rd., Hayward, Calif. 94541

[21] Appl. No.: 255,701

[22] Filed: Apr. 20, 1981

[51] Int. Cl.[3] ..... H01H 35/14

[52] U.S. Cl. ..... 200/61.52; 200/61.93; 340/65; 340/566

[58] Field of Search ..... 200/61.45 R, 61.45 M, 200/61.46, 61.47, 61.48, 61.49, 61.5, 61.51, 61.52, 61.53, 85 R, 61.83, 61.93, 161; 307/10 AT, 121; 340/566, 65

[56] References Cited

U.S. PATENT DOCUMENTS 3,047,699 7/1962 Patti ..... 200/61.52 X
4,124,841 11/1978 Kettunen ..... 340/566

*Primary Examiner*—A. T. Grimley
*Assistant Examiner*—Morris Ginsburg
*Attorney, Agent, or Firm*—Linval B. Castle

[57] ABSTRACT

A vibration and shock-sensitive electrical switch comprising a disc mounted tube with a small snap switch such as a Microswitch centered above the tube end on the disc surface. A switch-actuating wire extends from the switch trigger mechanism through the tube so that when the tube is balanced on its bottom end, the switch is in its first switching position, and when tipped over by vibration or shock, the switch-actuating wire is released and the switch goes to its second switching position. Vibration sensitivity may be adjusted by attaching various diameter or irregular shaped collars on the bottom end of the tube.

7 Claims, 6 Drawing Figures

SHOCK-SENSITIVE ELECTRICAL SWITCH

BRIEF SUMMARY OF THE INVENTION

This invention relates generally to electrical switches and particularly to a novel electrical switch that may be used to trigger an alarm or the like when subjected to vibration or shock above a predetermined level.

Such a vibration and shock-sensitive switch has many purposes and may be used, for example, to actuate vehicle burglar alarms or to actuate electrical valves that should be closed in the event of an earthquake.

Briefly described, the vibration and shock-sensitive switch comprises a disc, the center of which is mounted to the end of a short vertical tube perpendicular to the disc's surface. A small electrical switch, such as a Microswitch, is centrally located on top of the disc. A switch-actuating wire or rod extends from the switch trigger through the tube. When the tube is vertically balanced on a flat surface, the switch-actuating wire is forced upward to actuate the switch into its first switching position. When vibration or shock closes the tube and disc to tip over, the wire releases the switch to its second switching position.

DESCRIPTION OF THE DRAWINGS

In the drawings which illustrate a preferred embodiment of the invention.

DETAILED DESCRIPTION

Figure 1:
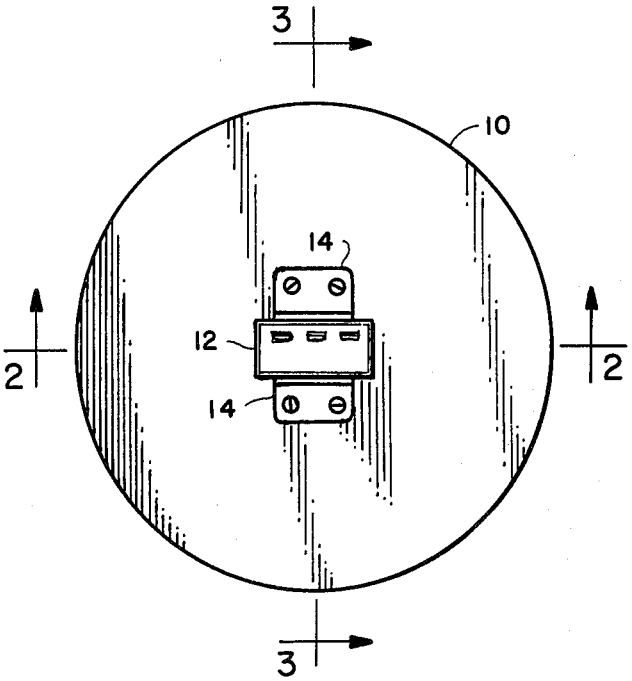
FIG. 1 is a top plan view illustrating the disc surface and the switch centrally mounted thereon.

FIG. 1 is a top plan view of the vibration and shock-sensitive switch and illustrates a disc 10 with a Microswitch 12 centrally positioned thereon and attached thereto by angle brackets 14. Disc 10 is preferably formed of a relatively thin metal or plastic and may have an overall diameter in the order of 10 to 20 centimeters. In the preferred embodiment, a circular disc is employed; however, the invention will work equally well by the use of a plate having a square or irregular shape. It is important, however, that, whatever the shape of the plate or disc 10, the switch 12 must be positioned directly over the center of gravity.

Figure 2:
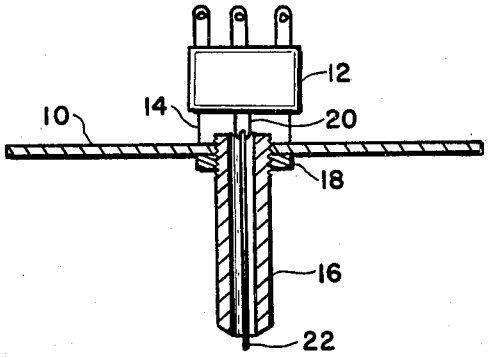
FIG. 2 is a sectional elevation view taken along the lines 2—2 of FIG. 1.

FIG. 2 is a sectional elevation view illustrating the plate or disc 10 mounted to a vertical tube 16. The top end of tube 16 is threaded into corresponding threads in the center of the disc 10 and is locked therein by a locking nut 18. If tube 16 is threaded into the disc 10 so that the length of the tube extending downward from the bottom of the disc surface equals about half the radius of the disc, the switch assembly balanced on a flat surface will have a certain sensitivity to shock and vibration and when tipped, the switch will properly function. If the tube is made effectively longer by unscrewing it several turns, the sensitivity to shock and vibration will be increased.

In the preferred embodiment, the switch 12 is a single pole double throw switch having a trigger, the inward and outward movement of which switches the poles of the switch 12 between its first and second switch positions. Connected to the switch trigger 20 is an actuating rod or wire 22 that extends through the bore of the tube 16 and from the open bottom end thereof. Thus, when the wire 22 extends from the bottom of the tube 16, the switch 12 is in its second switching position. However, when the wire 22 is flush with the bottom end of the tube 16, the switch 12 will have switched to its first switching position.

Figure 3:
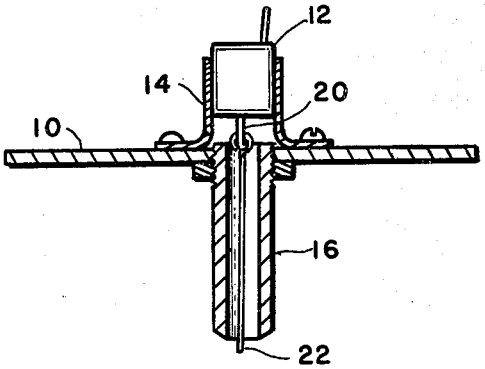
FIG. 3 is a sectional elevation view taken along the lines 3—3 of FIG. 1.

FIG. 3 is a sectional elevation view taken along the lines 3—3 of FIG. 1 and illustrates the actuating wire 22 coupled through a hole in the switch trigger 20. It is important to note that the switch 12 is over the center of gravity of the plate or disc 10 so that the entire assembly may be balanced on a flat surface on the bottom open end of the tube 16. It may also be noted that the plate or disc 10 may be used to support a battery and audible alarm as long as they are properly positioned to maintain the center of gravity of the disc 10 on the central longitudinal axis of the tube 16.

Figure 4:
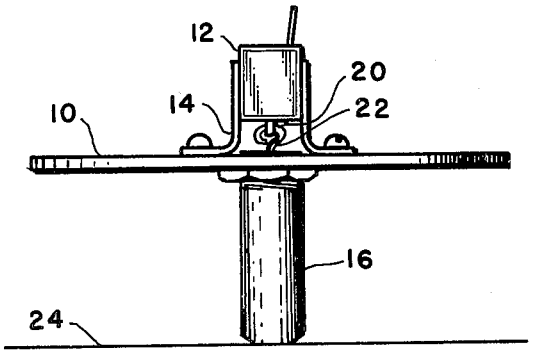
FIG. 4 is an elevation view of the switch assembly with the tube balanced on a flat surface.

FIG. 4 is an elevation view of the switching assembly illustrated in its balanced position on a flat surface 24. In this position, the bottom end of the actuating wire 22 becomes flush with the bottom surface of the tube 16 and the switch trigger 20 is depressed to set switch 12 into its first switching position.

Figure 5:
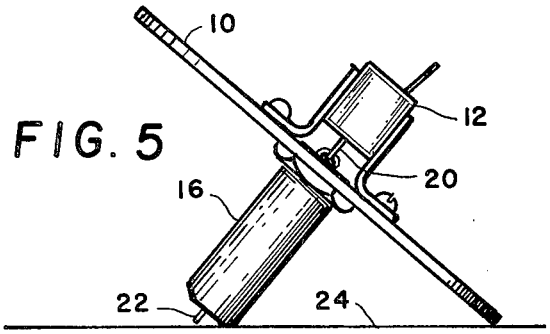
FIG. 5 is an elevation view of the switch assembly in its tipped position.

FIG. 5 is an elevation view of the switch assembly of FIG. 4 after a shock or vibration has tipped the switch as shown. In this position, the switch activating wire 22 is no longer held in its upward position by the weight of the switch assembly and the wire 22 again protrudes below the bottom surface of the tube 16 to permit the switch 12 to return to its second switching position.

Figure 6:
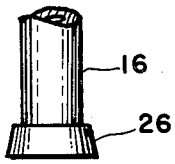
FIG. 6 is an elevation view of the bottom of the tube with an attached sensitivity reducing collar.

It will be noted that the bottom end of the tube 16 in the elevation views of the drawing is illustrated as being chamfered to reduce the effective diameter of the end of the tube and to thereby permit the tube to tilt with the slightest vibration or shock. In order to decrease the sensitivity of the switch assembly to thereby render it insensitive to mild vibrations such as caused by nearby vehicular traffic or the like, a foot enlarging collar 26 may be attached to the bottom of the tube 16 as illustrated in FIG. 6. If the switch assembly is to be sensitive to shock or vibration in all horizontal directions equally, the footprint of the collar 26 should be circular and of an area suitable for the particular desired shock sensitivity of the switch assembly. On the other hand, if it is desired to make the switch assembly particularly sensitive in one horizontal direction, the collar 26 may be non-circular, for example, elliptical with the minor axis of the ellipse aligned in the desired sensitive direction. Furthermore, if it is desired to make the switch assembly sensitive only in two right angle directions, the collar 26 may be square. Thus, while the circular collar 26 or the absence of a collar will permit the switch assembly to be equally sensitive in all directions, it can be made particularly sensitive in other directions by suitably shaping the bottom surface of the collar 26.

Having thus described my invention, what is claimed is:

1. An electrical switching assembly for switching from a first switch position to a second switch position when subjected to a predetermined level of shock and vibration, said switching assembly comprising:

a horizontal plate;

an electrical switch mounted to the top surface of said plate, said switch having an inward and outward actuating trigger extending downward through an opening in said plate at the center of gravity of said plate;

a vertical tube, the top end of said tube being connected to said plate through said opening at the center of gravity of said plate whereby the longitudinal axis of said tube is substantially aligned with said center of gravity; and an actuating rod connected to said switch actuating trigger, said rod extending through said tube and outward from the end thereof when said switch is in a second switch position, and the end of said rod being flush with the bottom end of said tube when said switch is in its first switch position.

2. The switching assembly claimed in claim 1 wherein the bottom end of said tube is chamfered on its exterior end surface to reduce the effective diameter of said tube to thereby increase the sensitivity of said switching assembly to shock and vibration.

3. The switching assembly claimed in claim 2 further including a collar coupled to the bottom of said tube for increasing the effective diameter of said tube to decrease sensitivity of said switching assembly.

4. The switching assembly claimed in claim 3 wherein said collar has a circular footprint.

5. The switching assembly claimed in claim 3 wherein said collar has a non-circular footprint for rendering said switching assembly particularly sensitive in predetermined horizontal directions.

6. The electrical switching assembly claimed in claim 1 wherein said horizontal plate is a circular plate and wherein said vertical tube has a length at least equal to half the radius of said disc.

7. The electrical switching assembly claimed in claim 1 wherein the top end of said vertical tube is longitudinally adjustable through an axial hole in said horizontal plate, the depth said tube is adjusted in said axial hole being a sensitivity adjustment of said assembly.

* * * * *